United States Patent [19]

Villa et al.

[11] 4,204,288

[45] May 27, 1980

[54] CONVERTIBLE SEAT-BED

[76] Inventors: Alfred S. Villa, 2511 Domingo Rd., Fullerton, Calif. 92635; Leo Jhigpen, Jr., 1665 N. Sycamore St., Orange, Calif. 92667

[21] Appl. No.: 909,918

[22] Filed: May 26, 1978

[51] Int. Cl.[2] ..... A47C 12/17

[52] U.S. Cl. ..... 5/47; 5/18 B; 297/383

[58] Field of Search ..... 5/17, 18, 37 R, 43, 5/47 R; 297/65, 63, 316–318, 321, 322, 383; 296/69

[56] References Cited

U.S. PATENT DOCUMENTS

| | | | |
|---|---|---|---|
| 2,279,286 | 4/1972 | Bell | 5/47 |
| 2,297,526 | 9/1972 | Boyer et al. | 5/47 |
| 4,030,750 | 6/1977 | Abram | 297/383 |
| 4,104,747 | 8/1978 | Bell et al. | 5/47 |

*Primary Examiner*—Casmir A. Nunberg
*Attorney, Agent, or Firm*—Whann & McManigal

[57] ABSTRACT

A convertible seat-bed in which a hinged connected seat frame and back frame are supported on a base structure and interconnected by a plurality of articulated control members which coact to control the movement of the seat frame and back frame between a seat forming position in which the seat frame extends generally horizontally and the back frame extends generally in an upright position, and a bed forming position in which the seat frame and the back frame extend horizontally in a generally coplanar relationship, the controlled movements of the back frame being such that the path of movement of the top edge portion of the back frame, during conversion from the seat forming position to the bed forming position and vice versa, is confined to a substantially vertical plane.

14 Claims, 4 Drawing Figures

FIG. 1.
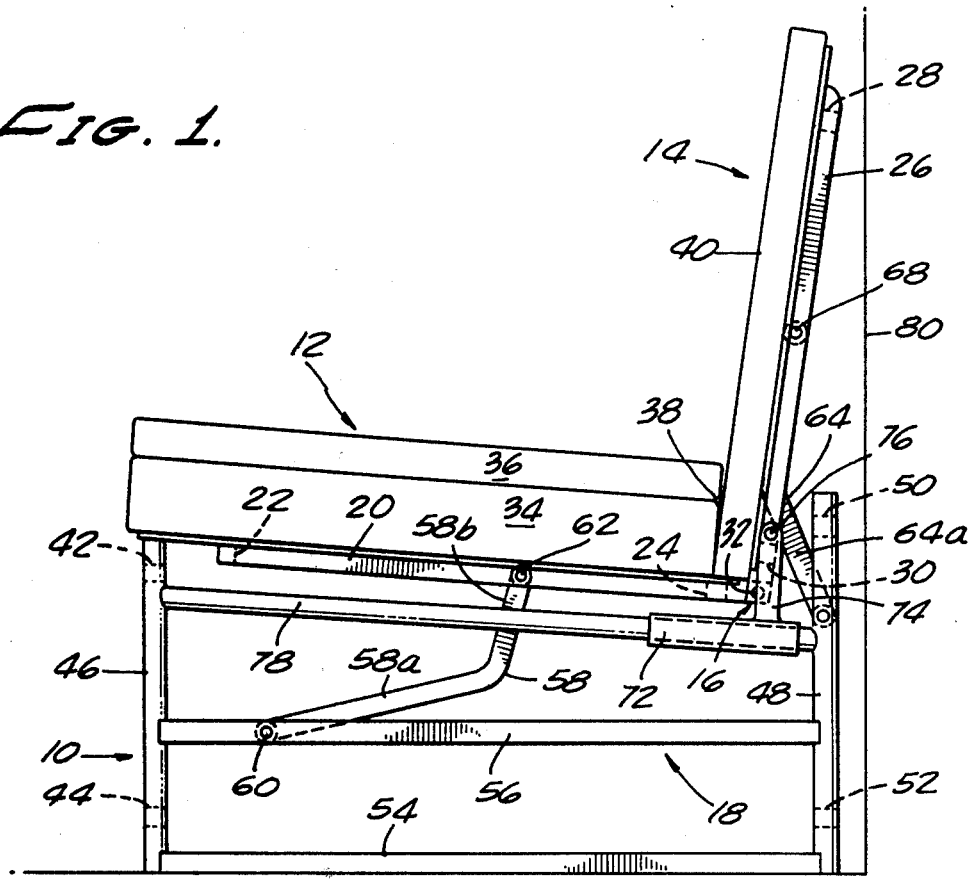
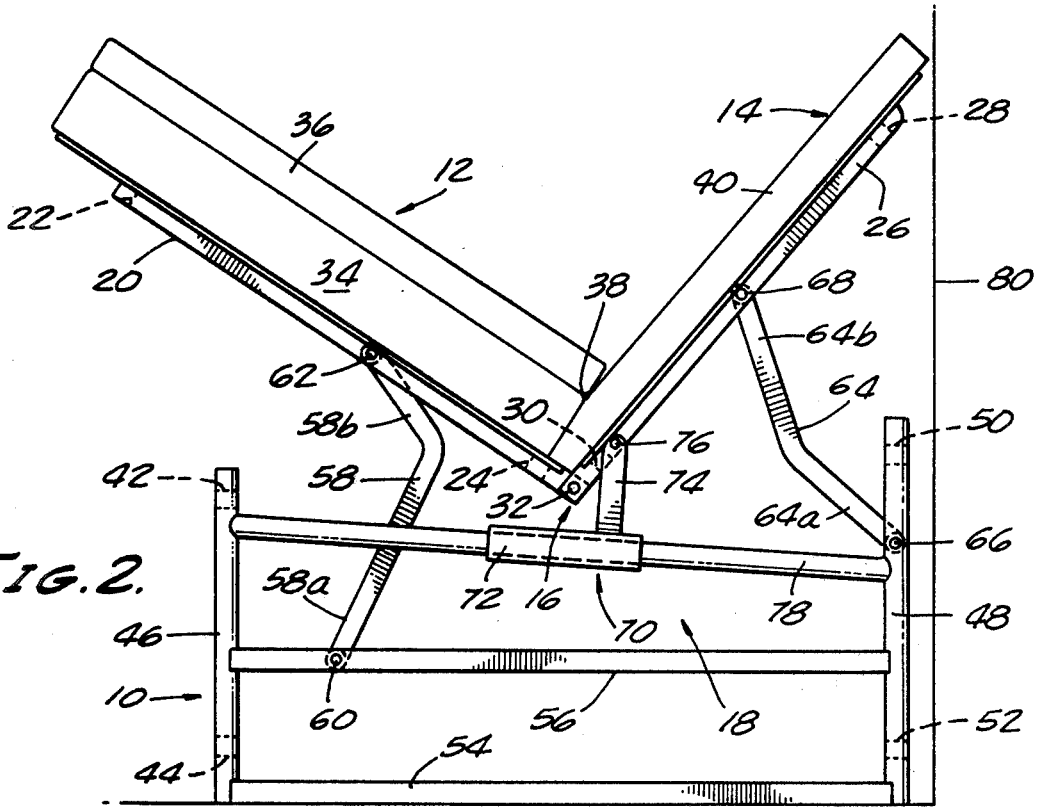
FIG. 2.

CONVERTIBLE SEAT-BED

BACKGROUND OF THE INVENTION

The present invention relates generally to the field of articulated bed and seat forming frame structures.

It has heretofore been generally known from a number of commercially available convertible sofa-bed structures to provide an interconnected seat frame and back frame which can be manually operated to effect a seat forming position and/or a bed forming position, and in which the translatory movements of the seat and back frames in going from one of these positions to the other, is controlled by an articulated linkage mechanism which may vary widely as to construction, design and complexity.

U.S. Pat. No. 3,657,747 is illustrative, and discloses a sofa-bed arrangement in which seat and backrest sections are supported relative to a base structure by a linkage mechanism which includes front and rear swing arms both of which are pivotally mounted to the base at their lower ends with the front swing arm being pivotally connected at its upper end to the seat section. The upper end of the rear swing arm is pivotally connected to a carrier link, one end of which is pivotally connected to the back-rest section with an intermediate portion thereof being pivoted to an intermediate portion of the front swing arm. The forward extremity of the carrier link is pivotally connected to an actuating link which in turn is pivotally connected to a support leg for the seat section to move the support leg between extended and retracted positions when the sofa-bed is moved between the bed and sofa positions. In this disclosed arrangement, a tension spring is provided to bias the sofa-bed in both of the sofa and bed positions and also to assist in moving it to either position.

The known arrangements have in general operated more or less satisfactorily to accomplish the conversion from a sofa to a bed, and vice versa. However, these arrangements have not in general been all that might be desired in this type of structure. The linkage mechanism is usually relatively complex and expensive, and the mechanical design is such that in some arrangements considerable manual effort is required to convert the sofa-bed from one position to the other, despite the use of assisting loading springs.

The present invention seeks to overcome the inherent disadvantages of the presently known structures by providing a novel and unique articulated control linkage in which the seat and back sections are hingedly interconnected, and are supported by a front link having one end pivoted on a base structure and another end pivoted on the seat, a rear link member having one end pivoted on the base structure and another end pivoted on the back, while an intermediate control member in the form of a bracket is slidably supported for movement on a base rail between the back and front of the base structure, the bracket having an upstanding portion pivotally connected to the back adjacent the hinged interconnection with the seat. This constitutes a greatly simplified linkage mechanism, and one which permits conversion from one position to the other with surprising ease of operation.

SUMMARY OF THE INVENTION

The present invention relates more particularly to a convertible sofa-bed structure, and is more specifically concerned with improvements in the linkage mechanism for controlling the movements of a seat frame and back frame, when converting from a seat to bed position and vice versa.

It is one object of the herein described invention to provide an improved and simplified convertible sofa-bed structure which can be quickly and easily changed between a sofa forming position and a bed forming position.

A further object is to provide such a sofa-bed that is economical of manufacture, which has a substantially all-metal frame construction, which is devoid of loading springs, and which is so designed that it may be readily and easily operated from one position to the other without excessive manual effort.

Another object is to provide such a sofa-bed which may be placed in close proximity to a back wall structure, and operated to a bed forming position without having to initially shift the position of the sofa-bed.

Further objects and features of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 1 is a side elevational view of a sofa-bed embodying the features of the present invention, showing the relationship of the components in the seat forming position;

FIG. 2 is a view similar to FIG. 1, but with the sofa-bed components disposed in an intermediate position between the seat forming position and bed forming position;

DESCRIPTION OF A PREFERRED EMBODIMENT

Figure 3:
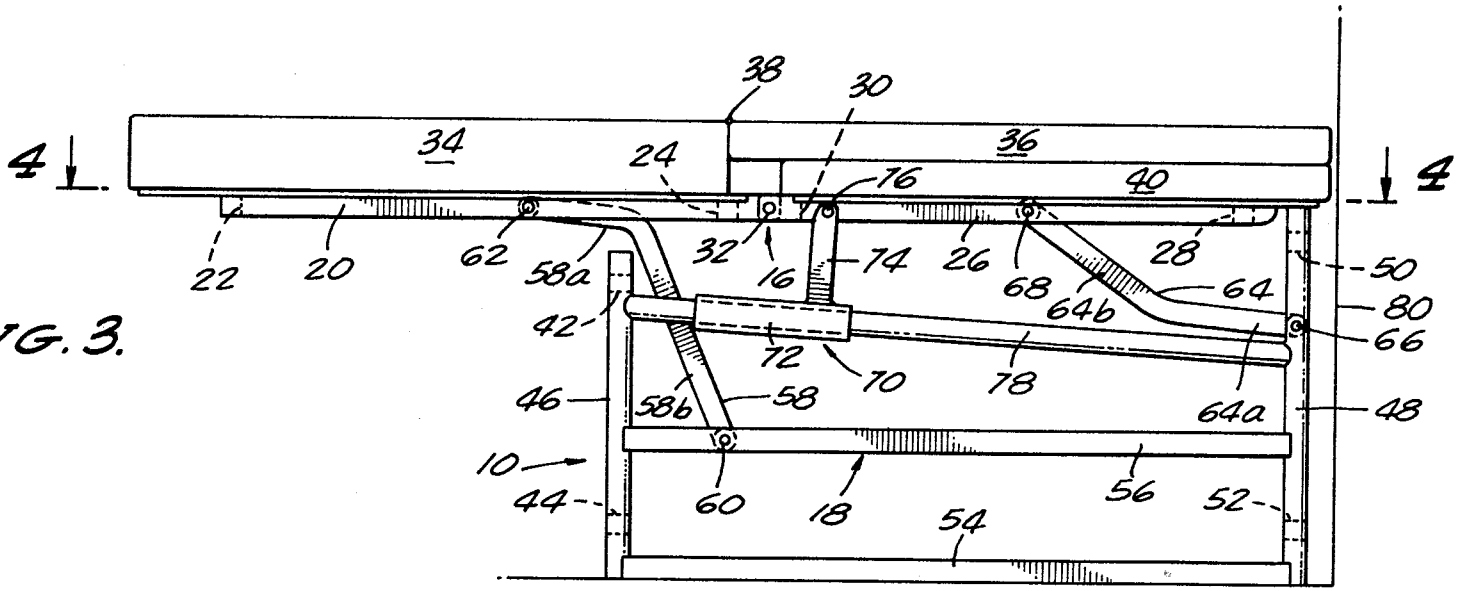
FIG. 3 is a view similar to FIG. 2, but with the sofa-bed disposed in the sofa position.
Figure 4:
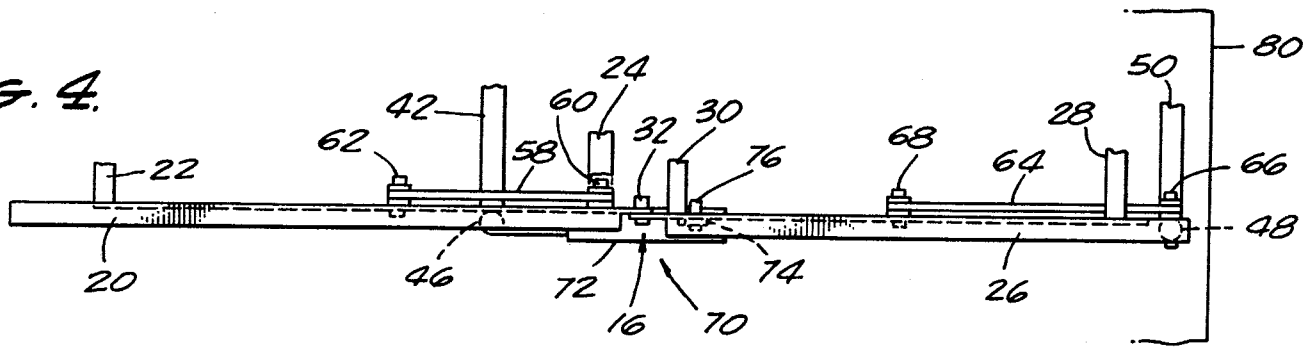
FIG. 4 is a plan view of the linkage mechanism illustrated in FIG. 3, as viewed substantially along line 4—4 of FIG. 3.

Referring now specifically to the drawings, a convertible bed-sofa embodying the features of the present invention is shown in FIG. 1 as comprising generally a base frame structure 10, a seat frame structure 12 and a back frame structure 14 having a hinge connection 16 with the seat frame 12, and a linkage control mechanism, as generally indicated at 18, for supporting the seat and back frames on the base for articulated movements between a seat forming position in which the seat extends generally horizontally and the back extends generally in an upright position, and a bed forming position in which the seat and back extend horizontally in a generally coplanar relationship.

The sofa-bed arrangement of the present invention discloses the operative components at one end thereof, and it is to be understood that a similar arrangement is provided at each end of the sofa-bed structure, and that the seat frame structure 12 and back frame structure 14 extends between the base frame structure at the respective ends of the sofa-bed.

More specifically, the seat frame structure 12 is fabricated to form a generally rectangular frame structure with end rails 20, preferably of angular transverse section, which are interconnected by suitable front and rear crossbars 22, 24. The back frame structure is similarly fabricated to provide a rectangular frame structure in which end rails 26 are interconnected by top and bottom crossbars 28 and 30. At the respective ends of the seat frame structure and back frame structure, the hinge connection 16 is formed by a suitable hinge pin 32 between the adjacent ends of the seat end rail 20 and the back end rail 26 so as to permit relative swinging movement between the seat and back during conversion from a seat forming position to a bed forming position, and vice versa.

Any suitable cushion or mattress arrangement may be utilized. In the disclosed embodiment, a double mattress or cushion consisting of a lower section 34 and an upper section 36, which are hingedly interconnected at 38 along their adjacent rear sides. To complete the cushion arrangement, there is also provided a removable back cushion 40. This cushion arrangement is such that in the seat forming position, the cushion sections 34 and 36 may occupy an overlying relationship, and the back cushion 40 may have its lowermost margin interposed rearwardly of the cushion sections with its lower portion extending into the space between the sections 34, 36 and the back frame structure 14. In the bed forming position (FIG. 3) the cushion upper section 36 is hinged to a position in overlying relationship to the back cushion 40. Preferably, the section 36 and back cushion 40 are of such thickness that in their combined overlying relationship, the resulting thickness will be substantially that of the section 34.

Any desired interconnection may be utilized between the base frame structures 10 at the opposite ends of the sofa-bed of the present invention. As illustrated, one such arrangement may comprise upper and lower crossbars 42 and 44, respectively, which extend between front post members 46, 46 of the base frame structures 10 at each end of the sofa-bed. At the rear, rear post members 48, 48 are similarly interconnected by upper and lower crossbars 50 and 52, respectively. Each base frame structure 10 is also constructed to provide spaced end rails 54 and 56 which extend between and have their ends welded or otherwise secured to the upstanding post members 46 and 48.

The control linkage mechanism 18 for supporting the seat and back frames on the base frame structures 10 at the respective ends of the sofa-bed structure, are identical as to their mechanical structure and operation. As shown, each control mechanism includes a front link member 58 which is deformed intermediate its ends to provide angularly disposed end portions **58*a* and 58*b* respectively. The end portion 58*a* is swingably connected with a front end portion of the end rail 56 by means of a suitable pivot 60, while the end portion 58*b* is connected with the end rail 20 of the seat frame structure 12 by means of a suitable pivot 62. A rear link member 64 is longitudinally deflected between its ends to form angularly extending end portions 64*a* and 64*b*, respectively. The end portion 64*a* is swingably connected adjacent the upper end of post 48 for swinging movement, by means of a suitable pivot 66, and the end portion 64*b* is swingably connected with the end rail 26 of the back frame structure 14 by means of a suitable pivot 68**.

The linkage control mechanism 18 further includes a control member 70 of generally an inverted T-shaped configuration in which a tubular crossbar portion 72 fixedly mounts an upstanding bracket arm 74 having its outer end pivotally connected adjacent the hinge connection 16 to the end rail 26 by means of a suitable pivot 76. As will be seen, the tubular crossbar portion 72 of the control member 70 is slidably supported on a tubular guide rail member 78 for rectilinear translatory sliding movements between the front post member 46 and rear post member 48. The rail member 78 is welded or otherwise connected to the post members and is positioned so that the end which is connected to the post member 46 will be elevated with respect to the end that is connected to the post member 48. As so arranged, it will be apparent that the pivot 76 will be gradually raised to a higher position as the control member 70 is slidably moved from its position adjacent the rear post member 48 to a position adjacent the front post member 46. This action is important for the reason that it will cause the seat member to be inclined in the seat position, but will be raised so as to bring the seat and back into coplanar relationship in the bed forming position. In the arrangement as just described, it will be noted that the pivot 60 of the front link member 58 is at a lower elevation than the pivot 66 of the rear link member 64.

In use, when in the seat forming position as shown in FIG. 1, the seat extends in a generally horizontal position but slightly rearwardly inclined, and the back extends generally in an upright position with its top portion rearwardly slightly inclined to provide a very comfortable and relaxing seat configuration. In this position, the control member 70 is positioned adjacent the rear post 48, the front link member 58 is in an inclined position extending towards the rear and the rear link member 64 extends generally in an upward direction. In this position, the forward end of the seat is shown as being supported by engagement with the upper ends of the front post members 46, 46 at the opposite ends of the sofa-bed.

When it is desired to convert the sofa-bed from the seat forming position as just described above into a bed forming position as shown in FIG. 3, it is only necessary to grasp the front side of the seat structure and pull it in a forward direction in a manner to cause the control member 70 to slidably move forwardly on the guide rail 78. This action, as shown in FIG. 2, causes the front link member 58 and rear link member 64 to swing in a counterclockwise direction about their respective lower end pivots. As a consequence of the swinging movement of the link members 58 and 64, and the translatory movement of the control member 70 along the upwardly inclined guide rail 78, the seat and back frame structures will be bodily raised and shifted forwardly as the seat and back are gradually hinged towards the bed forming position as shown in FIG. 3. The link members 58 and 64, and the control member 70 as arranged in the present invention are so designed and coordinated that during the transitional movement between a seat forming position and bed forming position and vice versa, the top portion of the seat will be maintained in a position forwardly of a vertical plane as represented by a rear wall 80, thus making it unnecessary to readjust the sofa-bed position either before or after conversion.

From the foregoing description and drawings, it will be clearly evident that the delineated objects and features of the invention will be accomplished.

Various modifications may suggest themselves to those skilled in the art without departing from the spirit of our invention, and, hence, we do not wish to be restricted to the specific forms shown or uses as mentioned except to the extent indicated in the appended claims.

We claim:

1. In a convertible seat-bed, or similar structure, in which a seat and a back are supported on a base and interconnected by articulated actuating means for controlling movement of the seat and back between a seat forming position in which the seat extends generally horizontally and the back extends generally in an upright position, and a bed forming position in which the seat and back extend horizontally in a generally coplanar relationship, the improvement in which the interconnecting means comprises:

a front swingable link member having a lower end pivoted on said base and an upper end pivoted on said seat;

a rear swingable link member having a lower end pivoted on said base and an upper end pivoted on said back;

means providing a hinged pivot interconnection of said seat and back along adjacent inner sides; and connection means positioned between said front link member and said back link member including a control member supported on said base for movements in opposite directions, and having a pivot connection with said back rearwardly spaced from said hinged interconnection.

2. A convertible seat-bed according to claim 1, in which:

said control member connection is slidably supported on said base.

3. A convertible seat-bed according to claim 1, in which:

said control member is supported on said base for guided translatory movements in a path between the front and rear of said base.

4. A convertible seat-bed according to claim 1, in which:

said control member comprises an upstanding bracket slidably supported on said base.

5. A convertible seat-bed according to claim 4, in which:

said bracket has a lower end slidably mounted on a transversely extending base rail member for rectilinear movements thereon.

6. A convertible seat-bed according to claim 5, in which:

the base rail member is of cylindrical transverse configuration; and said bracket is of an inverted T-shape with a tubular cross bar portion surrounding and slidable on said base member.

7. A convertible seat-bed according to claim 1, in which:

the link members and said control member are so correlated that the movement of the top portion of the back, during conversion from a seat forming position to a bed forming position and vice versa, follows a substantially vertical path of movement.

8. A convertible seat-bed according to claim 1, in which:

the front link member has said lower end pivoted on said base at a lower point than said lower end of the rear link member.

9. A convertible seat-bed according to claim 1, in which:

the link members coact in the bed forming position to support the seat with its front portion in a position projecting forwardly of said base in an overhanging elevated position.

10. A convertible seat-bed according to claim 5, in which:

said rail member is upwardly inclined from the rear to the front of said base.

11. A convertible seat-bed according to claim 5, in which:

the base pivot of the front link member is positioned below said rail, and the base pivot of the rear link member is positioned above said rail.

12. A convertible seat-bed according to claim 1, wherein said link members, hinged interconnection and control member are so formed and operatively connected that in the bed forming position the upper end pivots of the link members, the hinge pivot and the pivot connection of the control member will be in substantially coplanar relationship.

13. In a convertible seat-bed, or similar structure, in which a seat and a back are supported on a base and interconnected by articulated actuating means for controlling movement of the seat and back between a seat forming position in which the seat extends generally horizontally and the back extends generally in an upright position, and a bed forming position in which the seat and back extend horizontally in a generally coplanar relationship, the improvement comprising:

seat and back frame structures respectively having end rails;

a hinge pivot respectively connecting adjacent ends of the end rails of said seat and back frame structures for movement between a seat forming position and a bed forming position in which the seat and back frame structures are in substantially coplanar positions;

a front swingable link member at each end having a lower end pivoted on said base and an upper end pivoted on the seat end rail;

a rear swingable link member at each end having a lower end pivoted on said base and an upper end pivoted on the seat end rail; and a control member at each end supported on said base for rectilinear movements in opposite directions between the front and rear of said base, said control member having a pivot connection with the back end rail rearwardly spaced from the adjacent hinge pivot.

14. A convertible seat-bed according to claim 13, in which:

the control member is slidably supported upon a rail member that is upwardly inclined from the rear to the front of said base to thereby support the hinge pivot at the rear of the base at a relatively lower elevation so as to incline the seat structure in the seat forming position, and at the front of the base in a relatively higher elevation so as to place the seat and back structures in substantially coplanar relation in the bed forming position.

* * * * *